US005632225A

United States Patent [19]

Krasner

[11] Patent Number: 5,632,225

[45] Date of Patent: May 27, 1997

[54] LINE AND PAGE BOOKMARKER

[76] Inventor: Herbert A. Krasner, 5860 N.W. 44th St., Apt. 215, Lauderhill, Fla. 33319

[21] Appl. No.: 380,400

[22] Filed: Apr. 27, 1995

[51] Int. Cl.[6] ..... B42D 9/00

[52] U.S. Cl. ..... 116/235; 116/240; 281/42

[58] Field of Search ..... 116/234–240; 281/42; D19/34

[56] References Cited

U.S. PATENT DOCUMENTS

| | | | |
|---|---|---|---|
| D. 289,423 | 4/1987 | Lawrence | D19/34 |
| D. 307,442 | 4/1990 | Cooper | D19/34 |
| 399,417 | 3/1889 | Lane | 116/236 |
| 2,953,115 | 9/1960 | Haskins | 116/235 |
| 4,186,683 | 2/1980 | LeRoy | 116/235 |
| 4,901,665 | 2/1990 | Carlin | 116/235 |
| 5,081,948 | 1/1992 | Walsh | 116/235 |
| 5,311,835 | 5/1994 | Knowles | 116/235 |

*Primary Examiner*—William A. Cuchlinski, Jr.
*Assistant Examiner*—Andrew Hirshfeld

[57] ABSTRACT

A bookmark that identifies a line last read as well as whether the line is on a right page of a book or a left page of the book. Disposed upon a first side of the bookmark is a left page designator which includes an arrow for pointing to a line of text and an alphabetic designation for denoting the left page of the book. Disposed upon a second side of the book is a right page designator which includes an arrow for pointing to a line of text and an alphabetic designation for denoting the right page of the book. The alphabetic designation on the second side of the bookmark is arranged to be upside down with respect to the alphabetic designation on the first side of the bookmark.

1 Claim, 1 Drawing Sheet

LINE AND PAGE BOOKMARKER

FIELD OF THE INVENTION

The present invention relates to a bookmark, and more particularly a bookmark capable of directing a reader to a specific line and page of a book.

SUMMARY OF THE INVENTION

The present invention is a bookmark having a first side and a second side opposite the first side. Disposed on the first side is a left page designator which includes an arrow for pointing to a line of text and an alphabetic designation, such as the letter "L", for denoting the left page of a book. Disposed on the second side is a right page designator which includes an arrow for pointing to a line of text and an alphabetic designation, such as the letter "R", for denoting the right page of a book. The alphabetic designation on the second side of the bookmark is arranged to be upside down with respect to the alphabetic designation on the first side of the bookmark. Therefore, upon opening the book to expose the bookmark, a reader can inspect the bookmark to determine which alphabetic designation is in an upright or proper orientation, and hence which side of the bookmark is being utilized to indicate a page and line of the book.

DESCRIPTION OF THE PREFERRED EMBODIMENT OF THE INVENTION

Figure 1:
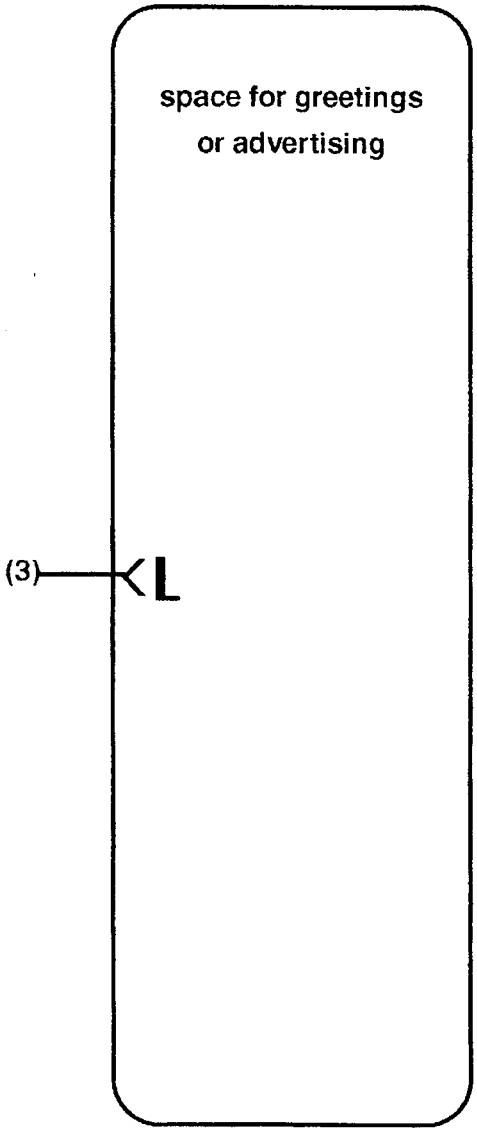
FIG. 1 is a front view of the bookmark, showing the left page designator.
Figure 2:
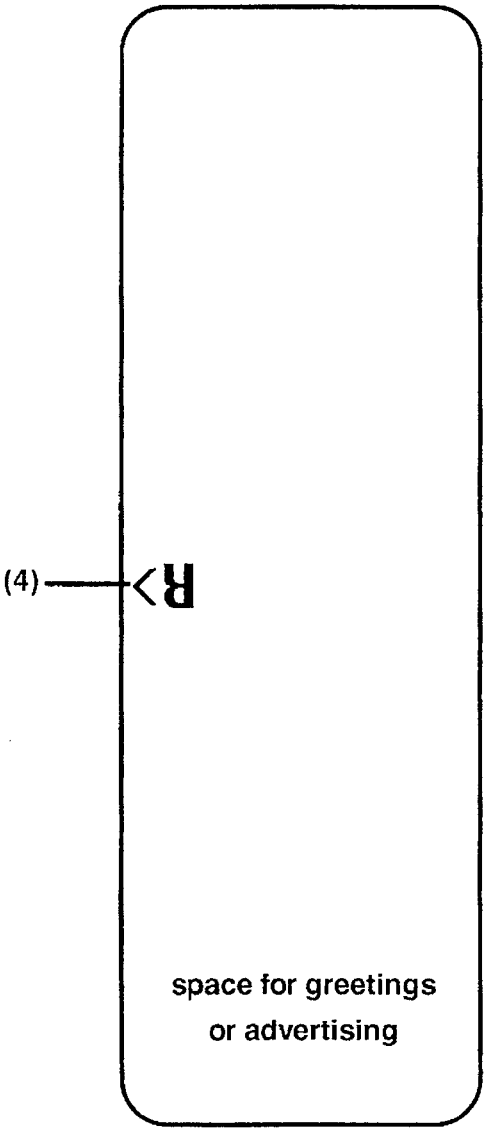
FIG. 2 is a rear view of the bookmark, showing the right page designator.

FIGS. 1 and 2 respectively illustrate the front and rear view of the bookmark of the invention. As shown in these figures, the bookmark includes a generally flat body having a first side and a second side opposite the first side. The first side is shown in FIG. 1 and the second side is shown in FIG. 2.

The generally flat body is bounded by a perimeter having a first edge, a second edge opposite the first edge, a third edge extending between the first and second edges, and a fourth edge opposite the third edge and extending between the first and second edges. The first edge is the top edge shown in FIGS. 1 and 2. The second edge is the bottom edge shown in FIGS. 1 and 2. The third edge is the edge to which the left designator 3 points, and the fourth edge is the edge to which the right designator 4 points.

As illustrated in FIG. 1, the left page designator 3 is immovably affixed to the first side of the body at a location substantially midway between the first and second edges. This arrangement leaves room for advertising space above and below the left page designator 3. The left page designator 3 includes an arrow "<" pointing toward, and in a direction generally perpendicular to, the third edge of the body for pointing to a line of text on the left page of a book. The left page designator also includes an alphabetic designation, such as the designation "L", of the left page of the book. This alphabetic designation is in an upright or proper orientation when the first side of the bookmark is viewed with the first edge disposed vertically above the second edge.

As illustrated in FIG. 2, the right page designator 4 is immovably affixed to the second side of the body at a location substantially midway between the first and second edges. This arrangement leaves room for advertising space above and below the right page designator 4. The right page designator 4 includes an arrow "<" pointing toward, and in a direction generally perpendicular to, the fourth edge of the body for pointing to a line of text on the right page of a book. The right page designator also includes an alphabetic designation, such as the designation "R", of the right page of the book. This alphabetic designation is in an upright or proper orientation when the second side of the bookmark is viewed with the second edge disposed vertically above the first edge.

The arrangement of the right page designator upside down relative to the left page designator provides an indication function for indicating which side of the bookmark is being utilized to denote the page and line last read. If the left page designator 3 is in a proper orientation (as shown in FIG. 1), then the bookmark is pointing to the left page of the book, and the line last read is that line adjacent to the arrow of the designator 1. Similarly, if the right page designator 3 is in a proper orientation (not shown in the figures), then the bookmark is pointing to the right page of the book, and the line last read is that line adjacent to the arrow of the designator 4.

I claim:

1. A bookmark consisting of:

a generally flat body having a first side and a second side opposite the first side, said body having a perimeter including a first edge, a second edge opposite the first edge, a third edge extending between the first and second edges, and a fourth edge opposite the third edge and extending between the first and second edges;

a left page designator immovably affixed to the first side of the body at a location substantially midway between the first and second edges, said left page designator including an arrow pointing toward, and in a direction generally perpendicular to, the third edge of the body, said left page designator also including an alphabetic designation of the left page, said alphabetic designation being in a proper orientation when said first side is viewed with said first edge disposed vertically above said second edge; and a right page designator immovably affixed to the second side of the body at a location substantially midway between the first and second edges, said right page designator including an arrow pointing toward, and in a direction generally perpendicular to, the fourth edge of the body, said left page designator also including an alphabetic designation of the right page, said alphabetic designation being in a proper orientation when said second side is viewed with said second edge disposed vertically above said first edge.

* * * * *